US005437113A

United States Patent [19]

Jones

[11] Patent Number: 5,437,113

[45] Date of Patent: Aug. 1, 1995

[54] SNOW PLOW TRIP CUTTING EDGE

[76] Inventor: Daniel K. Jones, 5337 Reiner Rd., Madison, Wis. 53704

[21] Appl. No.: 180,365

[22] Filed: Jan. 12, 1994

[51] Int. Cl.[6] ..... E01H 5/04

[52] U.S. Cl. ..... 37/233; 37/274; 172/265; 172/705

[58] Field of Search ..... 37/233, 232, 274, 231, 37/234, 235, 246, 270, 271; 172/264, 265, 261, 705

[56] References Cited

U.S. PATENT DOCUMENTS

| | | | |
|---|---|---|---|
| 1,925,397 | 9/1933 | Meyer | 37/233 |
| 3,014,289 | 12/1961 | Torrey | 172/705 |
| 3,429,059 | 2/1969 | Reissinger | 37/233 |
| 3,686,722 | 8/1972 | Li et al. . | |
| 3,772,803 | 11/1973 | Cote | 37/233 |
| 3,793,752 | 2/1974 | Snyder | 37/233 |
| 4,259,794 | 4/1981 | Rath | 37/232 X |
| 4,307,523 | 12/1981 | Reissinger et al. | 37/232 X |
| 4,571,217 | 2/1986 | Takano . | |
| 4,635,387 | 1/1987 | Häring | 172/705 X |
| 4,730,678 | 3/1988 | Denis et al. | 172/705 X |
| 4,745,653 | 5/1988 | Bliznac . | |
| 4,794,710 | 1/1989 | Häring | 37/232 |
| 4,976,054 | 12/1990 | Jones . | |
| 5,191,729 | 3/1993 | Verseef | 37/232 |

OTHER PUBLICATIONS

Brochure: Gledhill Road Machinery Company, "Gledhill: Trip Cutting Edge Snow Plows.".
Brochure: Viking Snow Plows, "Metropolitan Trip Edge Reversible Snow Plow.".
Brochure: Viking Snow Plow, "Heavy Duty Trip Edge Reversible Snow Plow.".
Brochure: Fisher Snow Plows, "Fisher Snow Plows.".
Brochure: Frink America, Inc., "Frink Trip Edge One-Way Plow.".
Brochure: Henke Manufacturing, "Snow Plows, Trip Cutting Edges.".
Brochure: Burke Truck & Equipment, "The Burke Special.".
Brochure: The Flink Company, "Baker/Flink Reversible Snow Plow: 450 Series.".
Brochure: The Flink Company, "Baker/Flink One--Way Snow Plows: 370 Series.".
Brochure: The Flink Company, "Baker/Flink Reversible Snow Plows.".
Brochure: The Flink Company, "Baker/Flink One--Way Snow Plows.".
Brochure: Monroe Truck Equipment, Inc., "Monroe Snow Plows: Polymer Plow/Trip-Edge Plow.".
Brochure: Schmidt Engineering and Equipment Company Ltd., "TE Series: Trip Cutting Edge Snow Plows; Shock Absorbing-Reversible.".

*Primary Examiner*—Randolph A. Reese
*Assistant Examiner*—Victor Batson
*Attorney, Agent, or Firm*—Dewitt Ross & Stevens

[57] ABSTRACT

A plow blade assembly including a moldboard, displaceable trip cutting edge connected to the moldboard, a moldboard receiving surface attached to the backside of the moldboard, a trip cutting edge contact surface attached to the backside of the trip blade, and a spring for urging the trip blade into a forward position. The trip cutting edge mechanism, located at the bottom edge of the moldboard, holds the trip cutting edge rigid for plowing but will allow it to give way upon contact with any solid object. The braking mechanism provides a large surface area which protects the trip blade mechanism from damage when the trip blade "bottoms out."

11 Claims, 5 Drawing Sheets

SNOW PLOW TRIP CUTTING EDGE

FIELD OF THE INVENTION

The present invention generally relates to snowplows and, more specifically, is directed to a trip cutting edge for a snowplow designed to be used on a large-scale highway snowplow system. Trip cutting edges or "trip edges" are designed to eliminate stress and damage to a snowplow blade by providing a blade edge which is resilient to obstacles on the road.

1. Background of the Invention

Snowplows are commonly used to plow snow from roadways, parking lots, and other areas. The snowplow is fitted on the front end of a vehicle and generally consists of a plow blade, including a moldboard and a trip cutting edge. The snowplow system may be removed during snow-free months to allow other uses for the vehicle.

The trip edge mechanism, which is located at the bottom edge of the moldboard, holds the trip edge of the snowplow blade rigid for plowing but will allow the trip edge to trip or rotate automatically upon contact with any solid object, and return immediately to the original plowing position when released. The purpose of the trip cutting edge (or trip edge) is to protect the main snowplow blade or moldboard when a snowplow hits an object in the road such as a manhole cover or the like. The trip edge is designed to rotate or "give" with the impact of hitting an obstruction. Obstructions may include manhole covers, crossings, safety arms, curbs, or surface irregularities. When the snowplow hits an obstruction, rather than damaging the entire snowplow and sometimes the truck, the trip edge will give way.

In the tripped position, the entire cutting edge assembly is rotated to the rear such that the cutting edge face slides easily up and over an obstruction. The extent of the rotation is controlled by mechanical stops or brakes to prevent overstressing of torsion devices.

2. Description of the Prior Art

Trip edges are well known to the art. A trip edge angle, which is a piece of angle iron or other metal, is pivotally attached to a snowplow moldboard. The trip edge angle urges the trip edge to a forward operating position with resilient torsion or compression springs.

Spaced at intervals along the trip edge are connection ears. A set of connection ears are attached to the moldboard to match up with a set of connection ears attached to the trip blade. Typically a steel rod is passed through eyelets in the connection ears connecting the trip edge to the moldboard.

Viking Snowplow, a division of Harrisville Manufacturing Company, Inc., Harrisville, N.Y., manufactures a plow assembly including a trip edge mechanism. The trip edge mechanism rotates with the bias of a torsion spring. Gledhill Road Machinery Company of Galion, Ohio also manufactures a snowplow assembly including a trip edge. The Flink Company of Streator, Ill. manufactures a snowplow assembly including either a sectional tripping edge or a one-piece trip edge. The sectional trip edge splits the trip edge into sections allowing each section to rotate individually when passing over an obstruction. A compression spring trip edge system is used by Monroe Snowplow, a division of Monroe Truck Equipment, Inc., Monroe, Wis.

Schmidt Engineering and Equipment Company, Ltd. of New Berlin, Wis. does not utilize a spring to absorb the shock of the rotating trip edge. Schmidt uses a canister shock absorber that incorporates metal plates that expand and contract, allowing for resiliency to absorb the jolt when the trip edge contacts an obstruction and having the force to push the trip edge blade back into its original position.

A deficiency with prior art torsion spring system trip edges is that after the trip edge impacts an obstruction and rotates backward, a final rotation stop position is obtained by the trip edge rear portion contacting the small surface of a protruding spring coil in the torsion spring system. In the compression spring system, a small surface area is used to break the impact of the rotating tripping edge. In either system, the small surface area used to break the entire tripping edge is minimal when compared to the amount of shock absorbed. Because of this, trip edges are damaged, moldboards are bent and springs are broken.

SUMMARY OF THE INVENTION

One object of the present invention is to provide the trip cutting edge or trip edge with extensive support on its back side to prevent damage upon rotation of the blade when it impacts an obstruction. Torsion spring trip edge assemblies have always allowed the trip edge to rotate until the back side pinched against the spring itself. The present invention allows for greater support and a larger surface area to spread out the force of an impact.

The present invention is specifically directed to a trip cutting edge attachment for a snowplow system, which includes a moldboard having a first upper end and a second attachment end, and a trip cutting edge having a first lower end and a second attachment end. The trip cutting edge is adapted to be rotationally displaced with respect to the moldboard.

The trip cutting edge attachment comprises a first planar section perpendicularly placed on the second attachment end of the moldboard. The first planar section includes a first impact surface area for receiving the impact of the trip cutting edge when the trip cutting edge is rotationally displaced. The first planar section substantially extends the length of the second attachment end of the moldboard.

The attachment further comprises a second planar section perpendicularly placed on the second attachment end of the trip cutting edge. The second planar section includes a second impact surface area for receiving the impact of the first impact surface area when the trip cutting edge is rotationally displaced. The second planar section substantially extends the length of the second attachment end of the trip cutting edge.

The attachment also includes a plurality of moldboard connection ears attached to the first planar section of the moldboard and a plurality of trip cutting edge connection ears attached to the second planar section of the trip cutting edge. Each of the connection ears includes a channel, such that the channels of the moldboard connection ears align with the channels of the trip cutting edge connection ears, and one trip cutting edge connection ear forms a connection ear pair with one moldboard connection ear. A shaft extends through the plurality of moldboard and trip cutting edge connection ears to rotationally engage the connection ears thereby rotationally attaching the moldboard and the trip cutting edge. The attachment further includes a plurality of spring-bias elements, each element being positioned between each connection ear pair.

An advantage of the present invention is its ability to spread the force of the impact of the trip cutting edge along the entire length of the moldboard. The length can measure from less than 5 feet on a small plow to 13 feet or more on larger plows.

The prior art only allows for the relatively small surface area of two to four spring bars at approximately ½ to 1½ inches each to absorb an impact. At best, the total surface absorption area is 6 inches square in the prior art devices. Conversely, the absorption of the present invention is 5 feet to 10 feet in length, or as much surface area as the blade is long.

Another advantage of the present invention results from the new positioning of the torsion springs. The torsion spring ends are now positioned away from the road. Thus, they are not worn down or "sharpened" by contacting the road when the plow is in use. Prior art torsion springs are positioned in a manner which allows the spring end to contact the road or protrude outward, causing a hazard. During use, the ends of the springs scrape along the road. After a sufficient time, the ends of the spring can be filed to sharp points. The ends of the spring then become dangerous to people working in the vicinity of the plow, for maintenance, plow removal or other procedures.

The present invention also provides a configuration which allows for less clearance between the torsion springs and the angles. This allows the spring ends to be trimmed shorter, providing a greater bearing surface.

Further objects, features and advantages of the invention will be apparent from the following detailed description when taken in conjunction with the accompanying drawings.

DETAILED DESCRIPTION OF THE INVENTION

Figure 1:
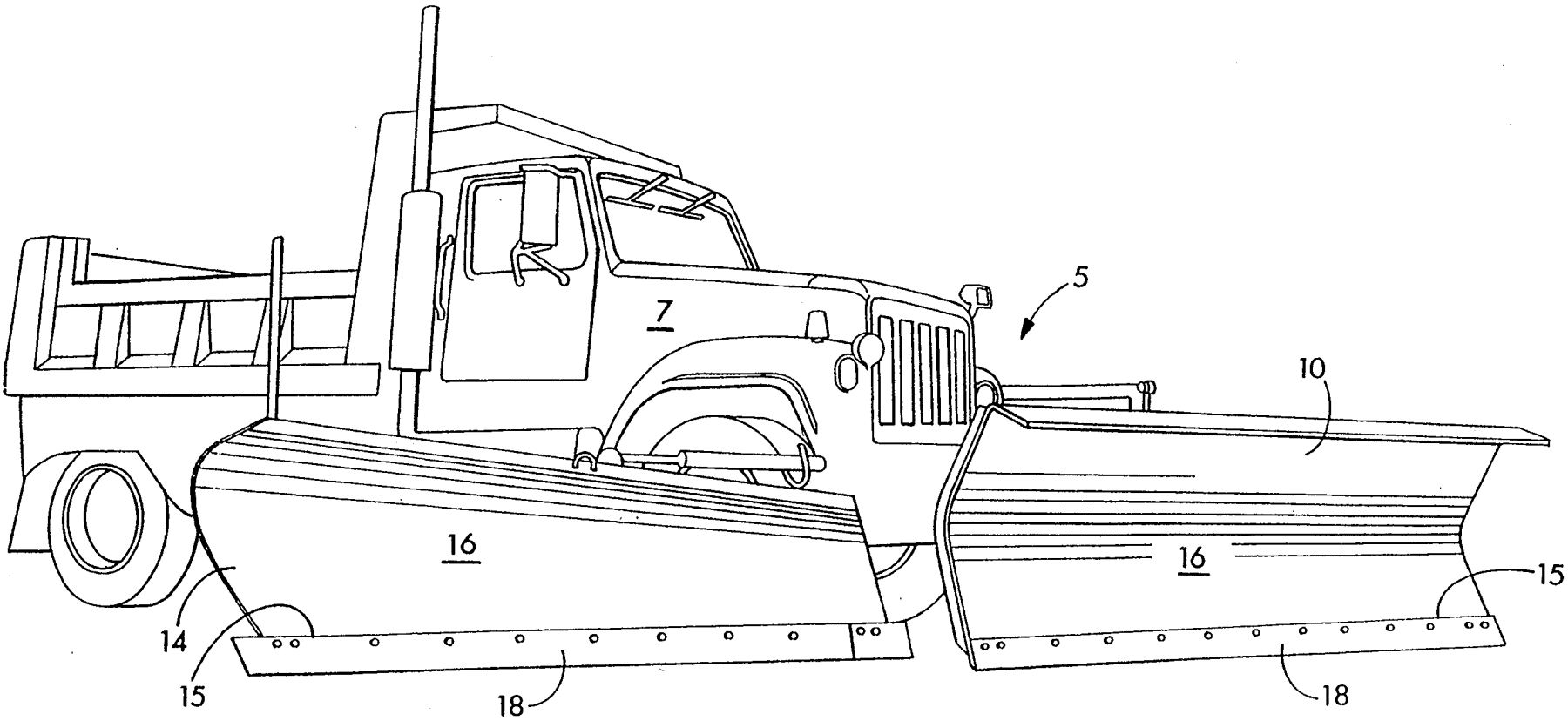
FIG. 1 is a perspective view of a typical snowplow truck with a snowplow assembly including a front positioned plow and a patrolling plow.

Referring now to the drawings, wherein like reference numbers refer to like elements throughout the several views, FIG. 1 illustrates a conventional snowplow system 5 including a motor vehicle 7 having a front snowplow blade 10 and a side mounting patrol wing blade 14. Examples of snowplow systems, which can be adapted to incorporate the trip edge system of the present invention, include but are not limited to those produced by the Gledhill Road Machine Company, American Road Machinery, Inc., Balderson, Bonnin Products, Inc., Bonnell Industries, Inc., Burke Truck & Equipment, Braun's Welding Service, Inc., Coates Manufacturing, Inc., Diamond Machine Co., Dierzen Welding & Machine Co., Everest, Little Falls Machine, Inc., Flink Co., Frink America, Industech, Inc., Lansco Corp,. Ramtec Limited, Root Spring Scraper Company, Tenco Machinery Ltd., Valk Manufacturing Co., Good Roads Products, Henke Manufacturing Corp., Viking Manufacturing Corp., Monroe Truck Equipment, Inc., Lawton's Equipment, Inc., Universal Highway Products and Schmitt Engineering & Equipment Co. Ltd.

As used herein, the term "snowplow blade" includes all manner of moldboard blades and grading devices designed for use in connection with a vehicle, preferably a motorized vehicle. It is within the scope of the present invention to include a number of different types of vehicles within the term "motor vehicle," including but not limited to conventional snowplow and bulldozer vehicles, light and heavy trucks, automobiles, tractors and ride-on lawn mowers. The only requirement is that the vehicle be adapted to either permanently or temporarily mount a snowplow blade. The mounting mechanism for the snowplow blade is conventional to the art and does not form a part of the present invention. For example, reference is made to U.S. Pat. Nos. 4,254,564 and number 4,528,762 for illustrations of typical snowplow blade mounting mechanisms.

The snowplow blade system 10 in FIG. 1 is a standard moldboard type plow including a moldboard 16 and a trip edge 18 attached to the lower end of the moldboard 16. The moldboard 16 and the trip edge 18 are generally constructed of a strong, high impact material, such as steel, in order to prevent damage to the blade system 10 as they are being used for shoveling snow.

As snowplow system 5 moves along a road, the front snowplow blade 10 or the patrol wing snowplow 14 or both may come in contact with an elevated object such as a raised manhole cover or the like in the road path. When the snowplow blade 10 passes over the obstruction, the trip cutting edge 18 attached to the moldboard 16 contacts the obstruction and rotates along an axis allowing the obstruction to pass beneath the moldboard 16 without damaging the moldboard 16 or any other part of the snowplow system 5.

Figure 2:
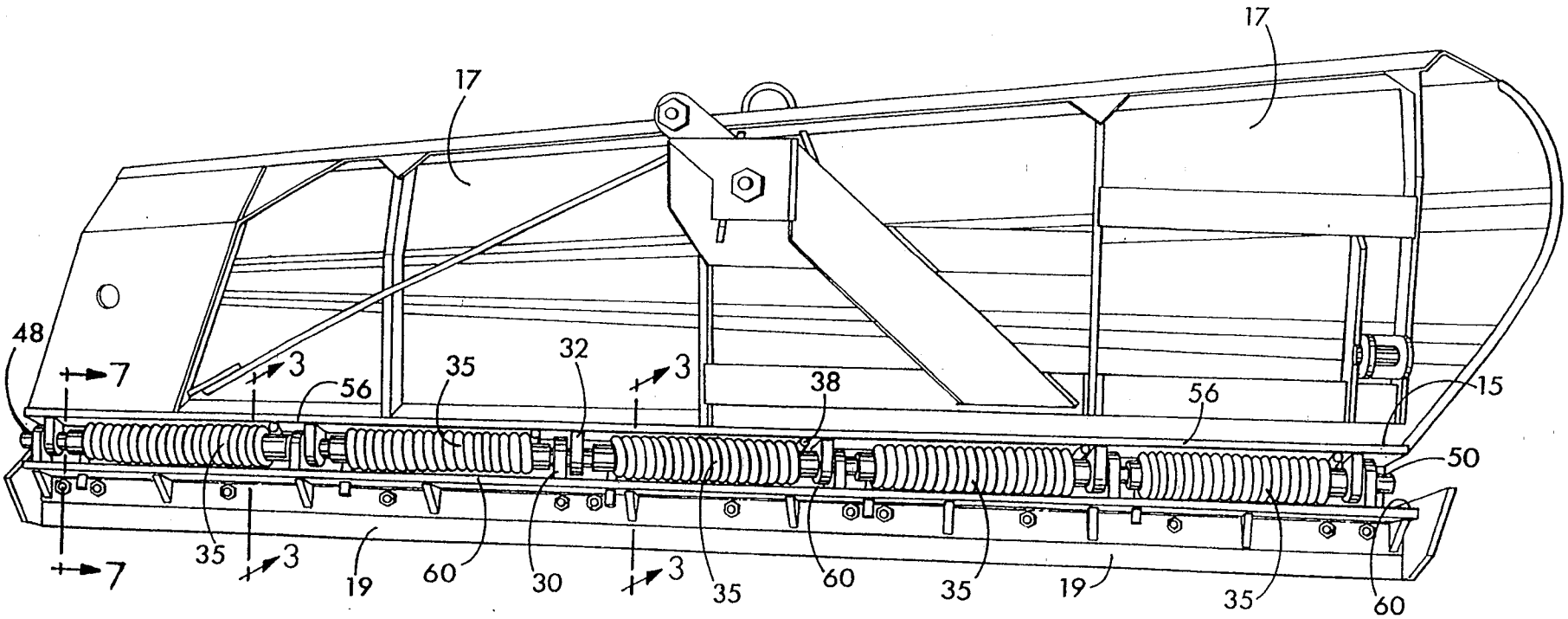
FIG. 2 is a rear view of a snowplow assembly including a moldboard, a trip cutting edge, connection ears, a connecting bar, and torsion springs.

It is within the scope of the present invention to provide a trip cutting edge 18 having one continuous length as illustrated in FIGS. 1 and 2, or the cutting edge 18 may be sectioned into individual sections (not illustrated). When the trip cutting edge 18 is sectioned, an obstruction hitting it will only rotate the particular section of the trip edge 18 leaving the other sections in their working positions.

The trip edge 18 is preferably dimensioned such that it spans the entire length of the first lower side 15 of moldboard 16, but may be slightly longer or shorter in two pieces or sections. The width of the trip edge 18 is generally the same as the width of the moldboard 16.

Figure 3:
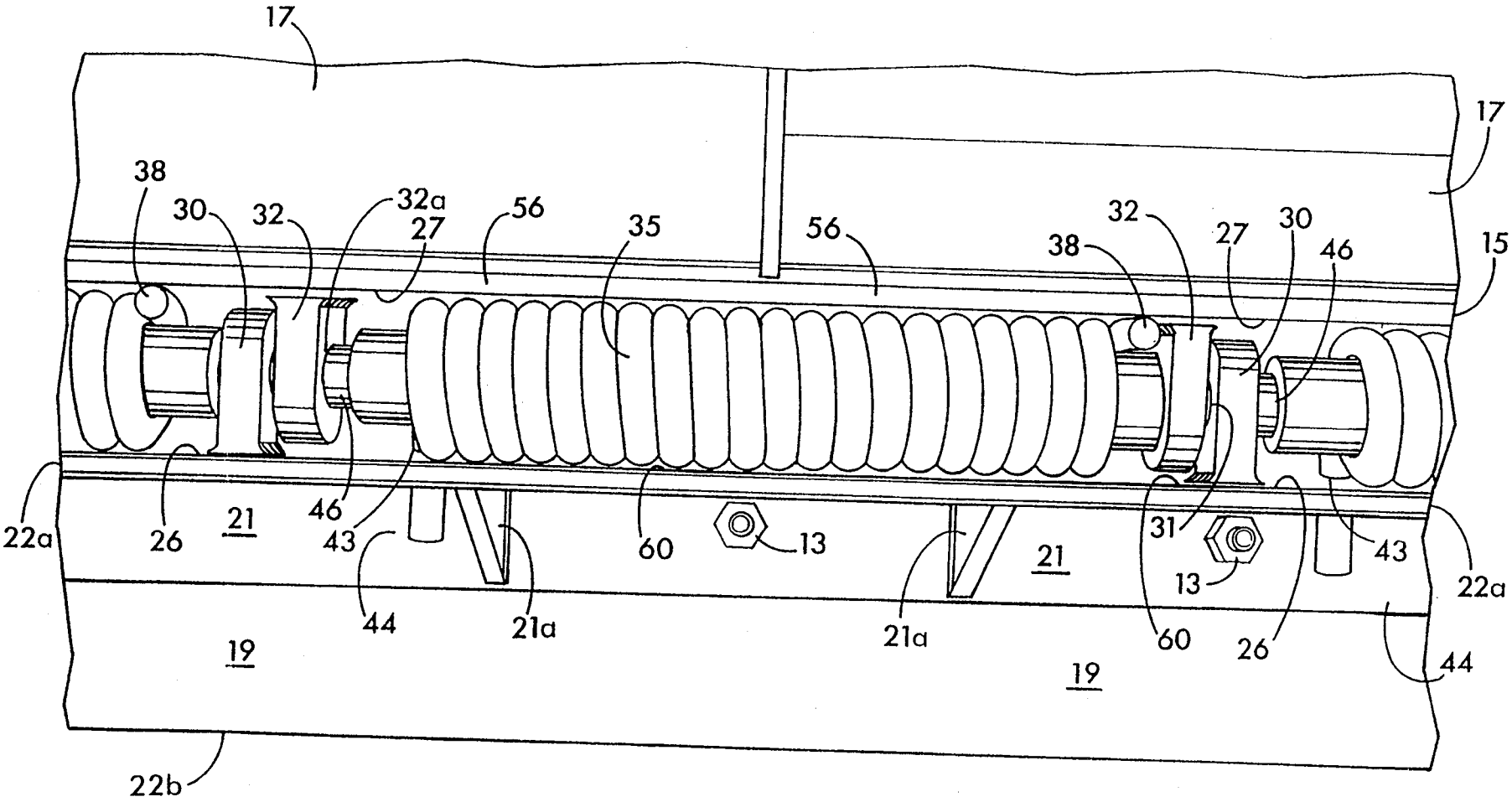
FIG. 3 is a rear isolated view of a portion of the snowplow assembly of FIG. 2 taken along lines 3—3.
Figure 4:
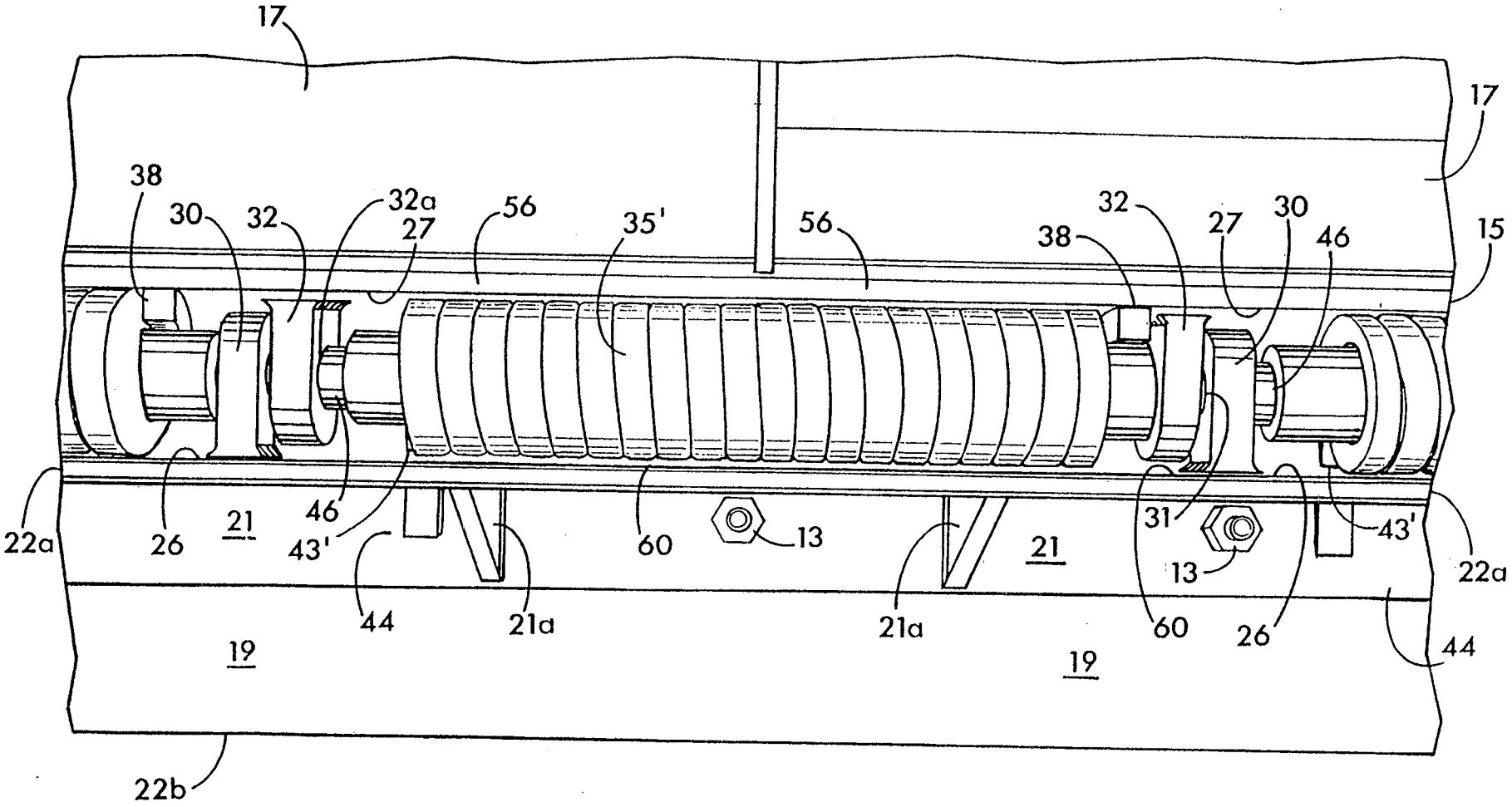
FIG. 4 is a rear isolated view of an alternative embodiment of a portion of the snowplow assembly of FIG. 2 taken along lines 3—3.
Figure 5:
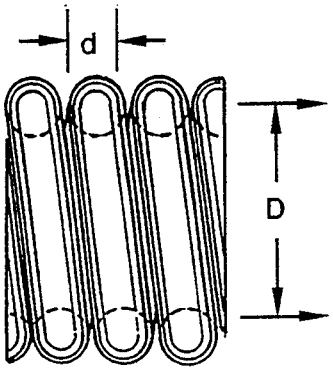
FIG. 5 is a fragmentary elevational view of a round spring, which is used in certain embodiments of the present invention.
Figure 6:
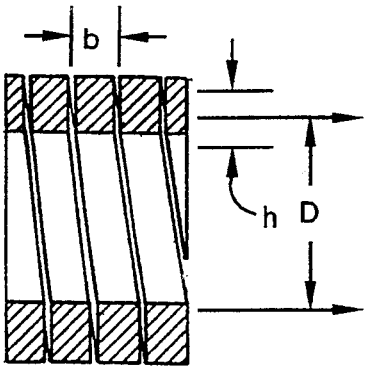
FIG. 6 is cross-sectional view of a square spring, which is used in other embodiments of the present invention.
Figure 7:
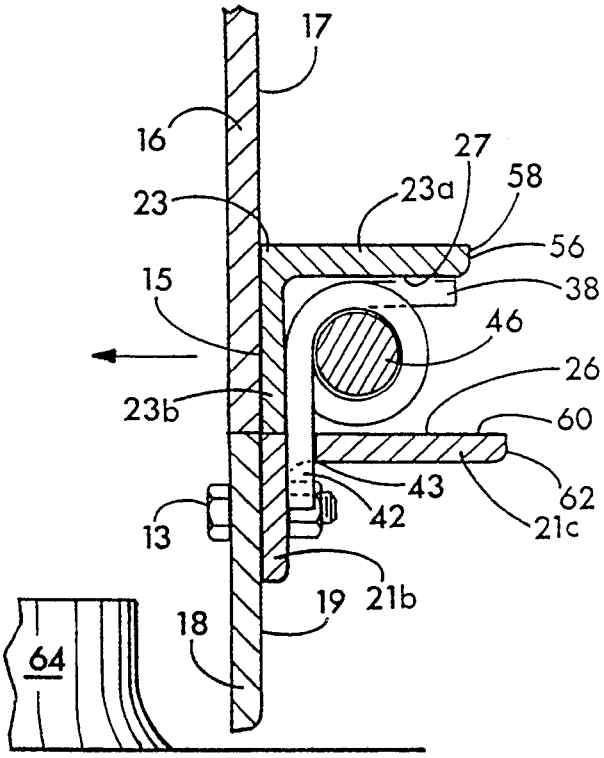
FIG. 7 is a cross-sectional view of the snowplow assembly of FIG. 2 taken along line 7—7.

Referring now to FIGS. 2–8, the trip edge 18 is connected to the moldboard 16 at the first lower end 15 of the back side 17 of the moldboard 16. As illustrated in FIGS. 3, 4 and 7, the back surface 19 of the trip edge 18 includes a first upper edge **22*a*** and a second lower edge 22*b*. The second edge 22*b* is the scraping or cutting edge.

The first edge 22*a* has an L-shaped angle 21 having a vertically disposed planar section 21*b* connected to a horizontal section 21*c*. The angle 21 is attached to the back surface along the entire length of the trip edge 18. The angle 21 is made from steel in the preferred embodiment and may be ¼ inch to 1½ inches thick. It is preferably attached to the back side 19 of the trip edge 18 with bolts 13, but may be attached by any method known in the art. The angle 21 has supports 21*a* securing the angle 21 at approximately 90° to the horizontal. The angle 21 is located at the first upper edge 22*a* of backside 19.

As shown in FIG. 7, a similar angle 23 having a horizontally disposed planar section 23a connected to a vertical planar section 23b is connected to the first end 15 of the back side 17 of the moldboard 16 in a similar manner as the angle 21. In the preferred embodiment, the angle 23 is bolted to the back side 17 of the moldboard 16. The angle 23 is made from the same materials as the angle 21 and also spans the entire length of the backside 17 of the moldboard 16, similar in length to the angle 21. In the preferred embodiment, the angle 23 is welded near to the first end 15 of the backside 17. Angles 21 and 23 are each attached in such a manner that they appear parallel to each other, such that section 21*b* of the angle 21 extends in the same direction (toward the ground or road surface) as the section 23*b* of angle 23.

As illustrated in FIGS. 2–4, upwardly depending connection ears 30 are attached to the first section 26 of the section 21*c* of the angle 21. The connection ears 30 are made of steel and are approximately ½ inch to 2 inches thick in the preferred embodiment. A channel 31 is defined by the connection ears 30 which is used to attach back side 17 to back side 19. The connection ears 30 are attached to the first section 26 of the section 21*c* by welding, in the preferred embodiment, but may be attached by any method known in the art.

Downwardly depending connection ears 32 are identical in construction to the connection ears 30; however, they are attached to the first section 27 of the section 23*a* of the angle 23 in a downward direction. The connection ears 32 are defined by a channel 32*a*. The connection ears 32 are mounted adjacent to the connection ears 30 such the channel 30*a* of the connection ears 30 aligns with the channel 32*a* of the connection ears 32. The connection ears 30 and 32 are spaced apart along angles 21 and 23 and may number from two each to six each in the preferred embodiment.

The biasing means include torsion springs 35, which are located between each set of connection ears 30 and 32 (one lower connection ear 30 with one upper connection ear 32 equals one set). As illustrated in FIGS. 2 and 3, round cross-sectional springs are typically used. Round cross-sectional springs are made by more manufacturing companies than other types of springs and their use is more wide spread. Therefore, an embodiment including round cross-sectional springs is contemplated by the present invention and the claims.

As illustrated in FIG. 4, the preferred biasing elements are rectangular or square cross-sectional springs 35′ (herein referred to as "square springs"). The square springs 35′ provide an improvement in transmission efficiency, especially under severe load conditions. The square spring embodiments provide a smaller angle of torsion resulting from the torque on the spring effected by the forcible urging of the movable trip edge as compared with the angle of torsion produced with the spring having a round cross-section. Reference is made to U.S. Pat. No. 4,571,217 to Takano, which is incorporated herein by reference for description of square springs and their advantages, as well as the description of the equation presented below.

The advantages of the square spring 35′ configuration over the typical round spring 35 configuration is described below with reference to FIGS. 5 and 6. The improved torsional rigidity of the square spring relative to the round spring may be seen by letting D denote the effective diameter of the spring, d denote wire diameter of the round spring, h and b denote the radial dimension and axial dimension respectively of the rectangular spring and $K_1$ and $K_2$ denote spring constants (kg/mm) of the round spring and square spring respectively. It follows that:

$$K_1 - \frac{W_1}{\tau_1} = \frac{Gd^4}{8ND^3}$$

$$K_2 - \frac{W_2}{\tau_2} = \frac{4k_2Ghb^3}{\pi ND^3}$$

where:

$\tau_1$=compressive deflection of the round spring.

$\tau_2$ =compressive deflection of the square spring.

$W_1$=compressive load (kg) on the round spring.

$W_2$=compressive load (kg) on the square spring.

N=number of turns of the spring.

G=modulus of elasticity in shear (kg/mm$^2$).

$k_2$=constant determined from h/b.

Letting $S_1$ and $S_2$ represent the torsional rigidity (kg-mm/radian) of the round spring and the square spring, respectively, then $$S_1 = \frac{M_1}{\phi_1} = \frac{Ed^4}{64ND}$$

$$S_2 = \frac{M_2}{\phi_2} = \frac{Ebh^3}{12\pi ND}$$

where:

$M_1$=torque (kg/mm) of the round spring.

$M_2$=torque (kg/mm) of the square spring.

$\phi_1$=angle of torsion (radian) of the round spring.

$\phi_2$=angle of torsion (radian) of the square spring.

E=modulus of longitudinal elasticity (kg/mm$^2$).

When a round and a square spring defined above are used as a spring in a snowplow trip edge assembly and if the two springs are the same length and effective diameter and under the same spring constant ($k_1=k_2$) then, from equations 1, 2 and 3

$$d^4=32\ k_2hb^3/\pi$$

When the round spring and the square spring are under the same conditions expressed as equal constants $k_1=k_2$, the ratio of torsional rigidity R is given as $R=S_1/S_2$ and, by substitution of equations, becomes $$R = S_1/S_2 = \frac{Ed^4}{64ND} \times \frac{12\pi ND}{Ebh^3} = \frac{3\pi d^3}{16bh^3}$$

which results in $$R = S_1/S_2 = \frac{6k_2b^2}{h^2}$$

It should be noted that with the present winding techniques for coiling a square spring, the value of b/h must be a minimum of about 0.54.

Substituting the minimum values of b/h=0.54, such minimum values being set by technical limitations in the present art. (the constant $K_2$ is 0.22 under this condition), so that $$R = 6 \times 0.22 \times 0.54^2 + .385 = \frac{1}{2.6}$$

The last equation indicates that a square spring is 2.6 times as torsionally rigid as a round spring when the two springs are the same in spring constant, effective diameter, and free length. That is, under the same torsional stress, the angle of torsion of the square spring is ½ of that of the round spring. Therefore, the square spring develops a smaller angle of torsion and withstands a heavier load indicating a greater torsional rigidity.

Figure 8:
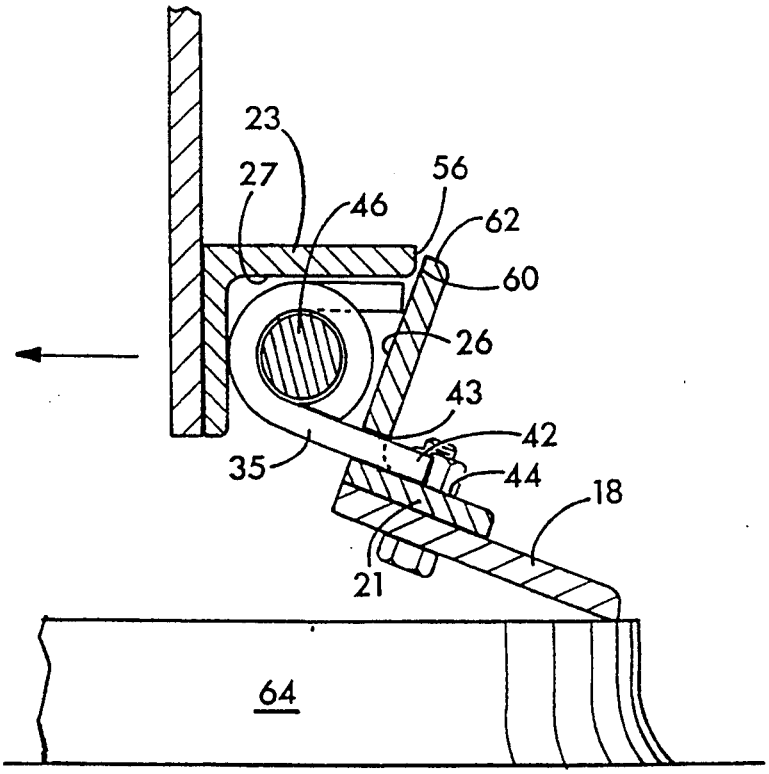
FIG. 8 is a cross-sectional view of the trip cutting edge when the trip cutting edge impacts an obstacle.

Unless otherwise noted, the remainder of the specification will be described with reference to round torsion springs 35. Referring now to FIGS. 7 and 8, the torsion springs 35 are illustrated as being located between first section 26 and second section 27, such that a small space is present between a torsion spring 35 and the first section 26 beneath the spring 35 and the section 27 above the spring 35. The torsion springs 35 are wound such that the first spring end 38 is adjacent to the second section 27 and the second spring end 42 passes through the first section 26 at angle aperture 43 (FIGS. 7 and 8). If square springs 35' are used, the aperture 43' has a square shape, as illustrated in FIG. 4.

The torsion springs 35 are torqued such that first spring end 38 is forced up against the second section 27 and the second spring end 42 is forced against the inner first side 44 of the angle 21 (FIG. 8). The torque force applied by the torsion springs 35 holds the trip blade 18 in its working position as shown in FIG. 7. However, the torque force also allows the trip blade 18 to give when it hits an obstruction (FIG. 8), compressing the resilient spring 35 until the obstruction is past and the torque forces the trip blade 18 back to its working position (FIG. 7).

A positioning bar 46 (FIGS. 3, 7 and 8) made from steel or a similar strong material is located through the aligned holes in the connection ears 30 and 32 and through channels inside torsion springs 35. When the positioning bar 46 is located within the holes in the connection ears 30 and 32, the trip blade 18 is securely connected to the moldboard 16. Further, the torsion springs 35 are held within position since they are wrapping the positioning bar 46. The positioning bar 46 is held in place at left end 48 and right end 50 with cotter or roll pins which are used in the preferred embodiment. However, any mode of attachment may be used. The positioning bar 46 has a diameter of ½ inch to 2 inches in the preferred embodiment.

When the snowplow assembly 5 is in use, the snowplows 10 and 14 will be typically moving in a forward direction over a surface such as a road. The surface is normally relatively flat. From time to time, obstructions may occur in the surface which would impede the forward motion of a snowplow assembly 5. However, the snowplow assembly 5 includes the trip blade 18, which functions to protect the snowplow assembly 5 and the truck to which it is attached from damage.

As the snowplow assembly 5 proceeds forward along a road surface, a raised obstruction such as a manhole cover 64 (FIGS. 7 and 8) may come in contact with the trip blade 18. The trip blade 18 is designed to contact the raised obstruction and rotate counterclockwise (left side view of snow assembly 5 as shown in FIGS. 7 and 8) until the obstruction passes or the trip blade 18 bottoms out. When the trip blade 18 bottoms out, there is no more resilient counterclockwise rotation allowed. In other words, the trip blade 18 cannot rotate further unless damage is done to the snowplow assembly 5.

However, the snowplow assembly 5 provides for a braking system superior to the prior art assemblies when the trip blade 18 bottoms out. That is accomplished by providing first receiving surface 56 (FIGS. 7 and 8) along the edge 58 of the angle 23. The first receiving surface 56 contacts the first contact surface 60 located near an edge 62 of the angle 21 when the trip blade 18 bottoms out. The elongated surface areas 56 and 60 provide for a great amount of strength spread over a large area.

In contrast, the prior art torsion spring devices allow the spring ends 38 and 40 to overlap the edges 58 and 62 of the angles 23 and 21. When the trip blade 18 impacts an obstruction, the trip blade rotates in a counterclockwise direction but bottoms out when the edge 62 of the angle 21 contacts the spring ends and overlapping them. Angle 21 will tend to push up and over the prior art spring ends and damage the entire trip blade assembly if the impact is forceful, which is frequent. Even if the damage is not significant after one incident of bottoming out, the continuous impacting will eventually cause maladjustment and misalignment problems. It can be easily deduced that the surface area provided by the widths of four or five spring ends or incorporated stops allows for a fraction of the strength and stability provided by the first receiving surface 56 in contact with the first contact surface 60 along the length of angles 21 and 23.

The foregoing is considered as illustrative only of the principles of the invention. Further, since numerous modifications and changes will readily occur to those skilled in the art, it is not desired to limit the invention to the exact construction and operation shown and described. Therefore, all modifications and equivalents that fall within the scope of the claims are embraced by the invention.

What is claimed is:

1. In a snowplow system including a moldboard having a first upper end and a second attachment end, and a trip cutting edge having a first lower end and a second attachment end, wherein the trip cutting edge is connected to and rotationally displaced with respect to the moldboard, a trip cutting edge attachment comprising:

a. a first planar section perpendicularly placed on the second attachment end of the moldboard, the first planar section including a first impact surface area for receiving the impact of the trip cutting edge when the trip cutting edge is rotationally displaced, wherein the first planar section substantially extends the length of the second attachment end of the moldboard;

b. a second planar section perpendicularly placed on the second attachment end of the trip cutting edge, the second planar section including a second impact surface area for receiving the impact of the first impact surface area when the trip cutting edge is rotationally displaced, wherein the second planar section substantially extends the length of the second attachment end of the trip cutting edge;

c. a plurality of moldboard connection ears attached to the first planar section of the moldboard, wherein each of the connection ears include a channel;

d. a plurality of trip cutting edge connection ears attached to the second planar section of the trip cutting edge, wherein each of the connection ears include a channel, such that the channels of the moldboard connection ears align with the channels of the trip cutting edge connection ears, and one trip cutting edge connection ear forms a connection ear pair with one moldboard connection ear;

e. a shaft extending through the channels of the plurality of moldboard and trip cutting edge connection ears to rotationally engage the connection ears thereby rotationally attaching the moldboard and the trip cutting edge; and f. a plurality of torsion springs, each spring being positioned between each connection ear pair, wherein each spring has a first end biased against the moldboard and spaced from the first impact surface area, and a second end biased against the trip cutting edge and spaced from the second impact surface area, so that the first ends and second ends are not pinched between the first impact surface area and the second impact surface area when the trip cutting edge is rotationally displaced.

2. The attachment of claim 1, comprising means positioning the first and second ends of the torsion springs out of contact with the first and second impact surface areas of the moldboard and the trip cutting edge.

3. The attachment of claim 1, wherein the first end of the torsion spring is adjacent the first planar section.

4. The attachment of claim 1, wherein the second planar section comprises a receiving aperture for receiving the second end of the torsion spring such that the second end is placed substantially parallel to the trip cutting edge.

5. The attachment of claim 1 wherein the torsion springs have a round cross-section.

6. The attachment of claim 1 wherein the torsion springs have a square or rectangular cross-section for greater torsional rigidity.

7. The attachment of claim 1 wherein each spring-biased element has a first end biased against the first planar section.

8. The attachment of claim 1 wherein each spring-biased element has a second end biased against the second planar section.

9. A trip cutting edge for a snowplow blade having a first lower end and a second attachment end, wherein the trip cutting edge is connected to and rotationally displaced with respect to a moldboard, the moldboard having a first upper end and a second attachment end, the trip cutting edge comprising:

a. A first planar section perpendicularly placed on the second attachment end of the moldboard, the first planar section including a first impact surface area for receiving the impact of the trip cutting edge when the trip cutting edge is rotationally displaced, wherein the first planar section substantially extends the length of the second attachment end of the moldboard;

b. a second planar section perpendicularly placed on the second attachment end of the trip cutting edge, the second planar section including a second impact surface area for receiving the impact of the first impact surface area when the trip cutting edge is rotationally displaced, wherein the second planar section substantially extends the length of the second attachment end of the trip cutting edge;

c. a plurality of moldboard connection ears attached to the first planar section of the moldboard, wherein each of the connection ears include a channel;

d. a plurality of trip cutting edge connection ears attached to the second planar section of the trip cutting edge, wherein each of the connection ears include a channel, such that the channels of the moldboard connection ears align with the channels of the trip cutting edge connection ears, and one trip cutting edge connection ear forms a connection ear pair with one moldboard connection ear:

e. a shaft extending through the channels of the plurality of moldboard and trip cutting edge connection ears to rotationally engage the connection ears thereby rotationally attaching the moldboard and the trip cutting edge; and f. a plurality of torsion springs, each spring positioned between a connection ear pair, and each spring having a first end and a second end, wherein each spring-biased element has a first end biased against the moldboard and spaced from the first impact surface area, and a second end biased against the trip cutting edge and spaced from the second impact surface area, so that the first ends and second ends are not pinched between the first impact surface area and the second impact surface area when the trip cutting edge is rotationally displaced.

10. The trip cutting edge of claim 9 wherein the springs have a square or rectangular cross-section.

11. The attachment of claim 9 wherein the second planar section includes a plurality of angle apertures, each angle aperture being adapted to receive the second end of a spring-baised element and position the second end away from the second impact surface area.

* * * * *